US005858933A

United States Patent [19]

Nikoloff

[11] Patent Number: 5,858,933

[45] Date of Patent: Jan. 12, 1999

[54] SURFACTANT-FREE LUBRICANT FOR COATING MOVING WEBS

[76] Inventor: Koyu P. Nikoloff, 750 Stony La., North Kingston, R.I. 02852

[21] Appl. No.: 132,975

[22] Filed: Aug. 12, 1998

Related U.S. Application Data

[63] Continuation-in-part of Ser. No. 730,819, Oct. 17, 1996.

[51] Int. Cl.[6] ..... C10M 105/32; C10M 105/56; C10M 105/74; B05D 3/00

[52] U.S. Cl. ..... 508/428; 508/463; 508/485; 508/491; 424/326; 424/361

[58] Field of Search ..... 508/428, 463, 508/485, 491; 427/326, 361

[56] References Cited

U.S. PATENT DOCUMENTS

| | | | |
|---|---|---|---|
| 4,200,551 | 4/1980 | Orthoerer | 252/312 |
| 4,766,015 | 8/1988 | Nikoloff et al. | 427/326 |
| 5,296,021 | 3/1994 | Clapp et al. | 106/2 |

OTHER PUBLICATIONS

ISBN: 0–89852–061–4; 1995, Paper Coating Additives; Ch. 7; pp. 69–88.

ISBN: 089852–454–7; 1988 Coating Fundamentals; Suspension Rheology for Coating.

ISBN: 0–89852–460–1; 1989, Structure of Paper Coatings: An update.

*Primary Examiner*—Margaret B. Medley
*Attorney, Agent, or Firm*—Barlow & Josephs, Ltd.

[57] ABSTRACT

An improved lubricant for coating moving webs is provided. The lubricant includes a chemically modified lecithin, such as hydroxylated or acethylated lecithin, and a fatty ester to completely eliminate the need for a surfactant in the composition. The mixture avoids foaming while maintaining the coating structure, even at high speeds found in modern printing equipment and processes. The lubricant improves coating rheology and maintains coating structure. The lubricant maintains a homogeneous coating, even at high speeds, thus resulting in superior coating and paper characteristics.

2 Claims, No Drawings

SURFACTANT-FREE LUBRICANT FOR COATING MOVING WEBS

This application is a continuation-in-part of Ser. No. 08/730,819, filed on Oct. 17, 1996.

BACKGROUND OF THE INVENTION

The present invention relates generally to lubricants for coating moving webs. More specifically, the present invention relates to an improved lubricant for coating webs moving at very high speeds.

In the paper manufacturing industry, paper and paper board web material is frequently coated to improve properties such as appearance and printability. The coating process involves applying a coating mixture to the paper as it moves at high speed through a coating apparatus. These coatings are typically composed of: (1) pigments, such as Kaolin clay, titanium dioxide, calcium carbonate or silicates; (2) adhesive binders, such as starches, styrene butadiene latex, or polyvinyl acetates; and (3) additives, which improve or modify specific properties and characteristics of the coating mixture.

A number of chemical phenomena and physical forces (particularly shear forces) can have a detrimental effect, e.g., destroying the integrity and uniformity of both the coating mixture and the coating as it is applied to the paper sheet. When this occurs, costly problems develop both in the application of the coating and in the finish quality of the coated paper. These problems are widely known to manufacturers of coated papers.

These problems are greatly magnified as the speed of the web moving through the coating apparatus is increased, causing increased shear forces on the coating mixture being applied. Increased speed causes problems in viscosity control, calcification, streaking, whiskering, and generally poor "runnability" (performance) of the coating. These problems ultimately result in a poor quality coated sheet and costly rejections. Uniformity of the coating mix at these high shear levels is critical.

Typically, lubricant additives, such as calcium stearate dispersions or polyethylene emulsions, have been used as an additive to the coating mixture to improve the performance and uniformity of the coating and the overall integrity of the coating mixture. The main function of a lubricant additive in a coating mixture is to increase the lubricity of the coating. However, many other effects of lubricants are known to the art of coating paper. For example, such characteristics as rheological properties, plasticity, smoothness, coating gloss, anti-dusting and improved printing qualities, can be affected by the use of coating lubricants.

In U.S. Pat. No. 4,766,015, issued to Nikoloff et al., attempts have been made to provide a lubricant with superior rheological properties. However, such prior art attempts do not adequately address the needs and related problems associated with high-speed printing on modem machines. The additive mixture of Nikoloff '015 includes a fatty acid, a surfactant and a crude lecithin component. However, since a fatty acid and crude lecithin are employed, a surfactant must also be employed for the mixture to be dispersible and lubricated enough to function properly as a paper coating mixture.

In U.S. Pat. No. 4,200,551, issued to Orthoefer, describes a chemically modified lecithin concentrate where various crude lecithins and surfactants are blended to form a water dispersible lecithin. Other types of chemicals modifications are also made to form hydroxylated lecithin, acetylated lecithin and others. The chemically modified lecithins disclosed in Orthoefer are particular well suited to the food industry due to the improved water dispersion properties.

The need for a superior lubricant is evident where the solid's density in a coating structure typically runs from 20.0–23.0 pounds per gallon while the liquid density typically runs from 8.0–9.5 pounds per gallon. The challenge lies in the ability to maintain the two densities in a coating structure together in one homogeneous coating even at the high speeds of greater than 6000 fpm. The modern, high-speed coating processes and equipment described above generates higher velocities than ever experienced before during application which, in turn, creates a centrifugal force that makes it more difficult to develop a stable clay coating. Therefore, there is a need to address the problems associated with the centrifugal force at which the coating is exposed during its application in maintaining the two densities together at high speed and velocities.

Recently, the foregoing concerns regarding paper coatings have become more and more important in light of modern, high-speed printing processes that have placed more and more demands on the performance of coated paper. In particular, over the last decade, the speed at which clay coatings are applied to paper have almost doubled and created the need for a better lubricant in coating moving webs. The demands of these new high-speed printing and coating processes have necessitated a change in the lubricants over the standard phospholipid (lecithin), calcium stearate or polyethylene used in the prior art. Since the speeds of modern printing processes often reach 6000 fpm, and possibly greater, superior lubricants are required to maintain the coating structure particularly where the coating colors are applied via the modem clay coating equipments. Such a superior lubricant is required to maintain the efficiency, economy and high quality from the manufacturers of coated paper while still maintaining the required optical properties of brightness, opacity and smoothness. However, there are no prior art lubricants which accomplish these goals and accommodate the modem printing equipment and processes. Therefore, an improved lubricant additive which accommodates these modem, high-speed printing machines and processes is desired to address those needs not found in the prior art.

SUMMARY OF THE INVENTION

The present invention preserves the advantages of prior art lubricants for coating moving webs. In addition, it provides new advantages not found in currently available lubricants and overcomes many disadvantages of such lubricants.

The invention is generally directed to a novel and unique lubricant for coating moving webs. The lubricant additive of the present invention includes a chemically modified lecithin, such as hydroxylated lecithin or acetylated lecithin, as well as a component of methyl ester to provide an overall improvement in the clay coating structure. In addition, the lubricant additive mixture of the present invention may also consist of only a chemically modified lecithin and a fatty ester and be totally devoid of surfactant. Coatings typically include natural and synthetic binders as well as various pigments, and final coated paper properties which is particularly well suited for modem, high speed printing processes and equipment. The composition of the present invention also includes a surfactant and may also include caustic soda as needed to adjust pH of the composition.

The addition of the lubricant composition of the present invention to any clay coating color substantially changes the entire coating structure. The incorporation of the inventive lubricant composition obviates the need to completely immobilize the pigment at the blade of the coater at the point of application. Applicant's discovery enables the coated structure to be maintained regardless of the physical forces and the pressure variations encountered during the coating process which, as a result, achieves superior coating characteristics and uniformity. The dispersibility of the chemically modified lecithin obviates the need for a surfactant particularly because the other component is a fatty ester, not merely a fatty acid. Eliminating a surfactant alleviates foaming tendencies. Foams are considered very detrimental to the paper coating as they cause fish eyes that result in a poor printing paper surface. The employment of a fatty ester, which has been reacted with glycol, for example, greatly improves the runnability of the mixture on coating equipment.

It is therefore an object of the present invention to provide a lubricant for coating moving webs which can maintain the coating structure uniform at very high processing speeds.

Another object of the present invention is to provide a lubricant composition for coating moving web which maintains a homogeneous coating at speeds up to and greater than 6000 fpm without foaming.

A further object of the present invention is to provide an improved lubricant for coating moving webs which can function to self-emulsify itself when added to the coating.

It is a further object of the present invention to provide an improved lubricant for coating moving webs which improves the coating rheology and maintain the coating structure very uniform.

It is yet a further object of the present invention to provide an improved lubricant for coating moving webs which obviates the need to completely immobilize pigment at the blade of the coating machine.

It is another object of the present invention to provide an improved lubricant for coating moving webs which provides a stable coating structure to effectively alleviate streaking, dusting, whiskering, blade scratching and weeping or keep them within an acceptable range.

It is yet a further object of the present invention to provide an improved lubricant for coating moving webs which enables the coating structure to be maintained regardless of the physical forces and pressure variations encountered during the coating process.

It is yet another object of the present invention to provide an improved lubricant for coating moving webs which enables superior coating uniformity, flow properties and brightness to be achieved even with high-speed processes.

DETAILED DESCRIPTION OF THE PREFERRED EMBODIMENT

Lecithin is a naturally occurring complex mixture of phospholipid which includes phosphatidyl choline, phosphatidylinsotial and phosphatidylethanolamine. This standard or common phospholipid is similar to that found in all living animals and vegetable cells. Today's new paper machines and coating equipment have been designed to run up to 6000 fpm thus creating a need for new lubricants or improvement on existing lubricants.

The present invention includes a chemically modified lecithin such as hydroxylated, acetylated and enzyme lecithins as opposed to the standard crude lecithins of the prior art and they require little or no surfactant in order to disperse in water. Hydroxylated lecithin is a light colored product with increased water dispersability and enhances oil in water and water in oil emulsifying properties. Hydroxylation of lecithin is carried out by a reaction of the crude lecithin with hydrogen peroxide and lactic acid or a peracid. The percentage of hydroxylated lecithin in the additive mixture is preferably in the range of 1–80 percent. H+ may include glacial, acetic, sulfuric, perlactic or peracetic acid.

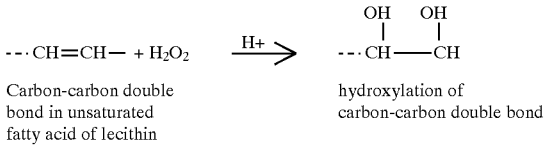

In the alternative, the present invention may include acetylated lecithin products made from natural soy or natural corn lecithin hydrates by treatment with acetic anhydride. The percentage of acetylated lecithin in the additive mixture is preferably in the range of 1–80%. Acetiliation occurs primarily on the amino group of phospatydlethanolamine. The amino group of the phosphatydlethanolamine when acylated introduces a substituent on the positively charged portion of the zwitterionic phosphatidylcholine and converts it to a negatively charged lecithin with improved solubility and oil in water and water in oil emulsifying properties not found in the prior art. The phosphatidylethanolamine which is the principal reactant with acetic anhydride in the manufacturing process thus resulting in acetylphosphatidylethanolamine involving the necleophilic acylsubstitution as illustrated:

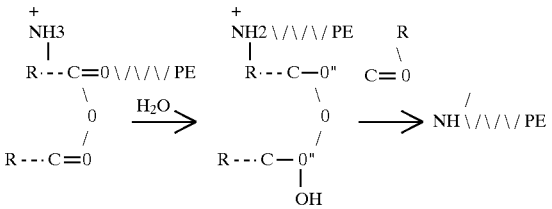

A degree of reaction is measured by determining amine nitrogen content in the resulting product, typically by formoltitration.

The improved solubility and oil in water and water in oil emulsifying properties of the modified lecithins according to the present invention enables the amount of surfactant in the lubricant to be greatly reduced. Surfactants generate large volumes of foam, particularly in higher speed equipment where more turbulence is generated. The use of large volumes of surfactants necessitates the addition of anti-foam and defoamers to control the foam which results in the detrimental effect of fish eyes or small pin holes on the paper coated surface. Since the modified lecithins necessitate relatively small to zero amounts of surfactants, defoamers can be essentially eliminated thus avoiding the pin hole effect, as described above.

When used, the surfactants can be nonionic, cationic, anionic or amphoteric surfactants and in the range of 0–12% of the additive mixture with 2–6% being the preferred range.

In addition, it has been discovered that esters, as opposed to fatty acids, have a synergetic effect with chemically modified lecithins to provide superior performance by providing extremely good coating structure. The standard crude lecithin known in the prior art are good only as water in oil emulsifiers where the dispersed phase is water and the continuous phase is oil. However, the chemically modified lecithins of the present invention can function to emulsify either water in oil or oil in water thus enabling the replacement of fatty acids with esters which greatly improves the overall coating rheology and the ability to maintain the entire coating structure. The methyl esters preferably derive from coconut, soy and other vegetable oils as well as tallow, and the like. The alkyl group range from $C_8$–$C_{20}$ with a preferred range of $C_{12}$–$C_{18}$. The iodine values range from 80–115. The total percent methyl esters are in the 70–98% range.

The lubricant for coating moving webs of the present invention provides a chemically modified lecithin instead of standard crude lecithin and incorporates methyl esters instead of fatty acids to greatly improve the overall clay coating structure and final coated paper properties. It has been discovered that the application of this novel lubricant composition with the chemically modified lecithin and methyl esters greatly improves the uniformity and quality of the coating in both the wet and dry states. It greatly reduces streaking, formation of whiskers, and fish eyes even at high speeds on modem coating equipment.

The following examples illustrate suitable lubricant compositions to accommodate and compliment the wide clay coating and printing requirements:

EXAMPLE 1

A charge of 470 pounds of hydroxylated lecithin is introduced into a vessel and subjected to agitation while being heated to 130°±5° F. Four hundred seventy (470) pounds of methyl esters is added and the mixture is stirred until homogeneous. Sixty (60) pounds of surfactant is added and the mixture is stirred until homogeneous. The resulting lubricant mixture is then added to a paper coating mixture at a level of 0.2 to 5% based on pigment solids and desired properties.

| ITEM | POUNDS |
|---|---|
| 1. Hydroxylated Lecithin | 470.0 |
| 2. Methyl Ester | 470.0 |
| 3. Surfactant | 60.0 |
| Total: | 1000.0 |

EXAMPLE 2

The procedure of Example 1 is followed with the following mixture:

| ITEM | POUNDS |
|---|---|
| 1. Acethylated Lecithin | 475.0 |
| 2. Methyl Ester | 475.0 |
| 3. Surfactant | 50.0 |
| Total: | 1000.0 |

EXAMPLE 3

The procedure of Example 1 is followed with the following mixture:

| ITEM | POUNDS |
|---|---|
| 1. Hydroxylated Lecithin | 150.0 |
| 2. Acethylated Lecithin | 150.0 |
| 3. Methyl Ester | 650.0 |
| 4. Surfactant | 50.0 |
| Total: | 1000.0 |

EXAMPLE 4

The procedure of Example 1 is followed with the following mixture:

| ITEM | POUNDS |
|---|---|
| 1. Hydroxylated Lecithin | 700.0 |
| 2. Methyl Ester | 250.0 |
| 3. Surfactant | 50.0 |
| Total: | 1000.0 |

EXAMPLE 5

The procedure of Example 1 is followed with the following mixture where a hydroxylated or acetylated lecithin is saponified at 20–35% solid and used as a partial emulsifier for the methyl ester. Caustic soda is added to adjust Ph during the saponification. A typical formulation is as follows and is mixed well in similar fashion to Example 1 and then homogenized.

| ITEM | POUNDS |
|---|---|
| 1. Water | 430.0 |
| 2. Saponified Lecithin | 100.0 |
| 3. Surfactant | 30.0 |
| 4. Methyl Ester | 440.0 |
| 5. Caustic Soda 50% to adjust pH to 7.5–8.5 | |
| Total: | 1000.0 |

EXAMPLE 6

The procedure of Example 1 is followed with the following mixture. Caustic soda is added as needed to adjust the pH of the mixture to between 7.5–8.5.

| ITEM | POUNDS |
|---|---|
| 1. Water | 500.0 |
| 2. Surfactant | 30.0 |
| 3. Methyl Ester | 470.0 |
| 4. Caustic Soda 50% to adjust pH to 7.5–8.5 | |
| Total: | 1000.0 |

EXAMPLE 7

Modifications can also be made from Example 6 to meet different paper mill requirements.

| ITEM | A LBS. | B LBS. | C LBS. | D LBS. |
|---|---|---|---|---|
| 1. Composition of Example 6 | 500.0 | 900.0 | 800.0 | 600.0 |
| 2. Saponified Lecithin | 500.0 | 100.0 | 200.0 | 400.0 |
| Total: | 1000.0 | 1000.0 | 1000.0 | 1000.0 |

EXAMPLE 8

The procedure of Example 1 is followed with the following mixture:

| ITEM | POUNDS |
|---|---|
| 1. Hydroxylated Lecithin | 470.0 |
| 2. Acetylated Lecithin | 470.0 |
| 3. Surfactant | 60.0 |
| Total: | 1000.0 |

EXAMPLE 9

The procedure of Example 1 is followed with the following mixture:

| ITEM | POUNDS |
|---|---|
| 1. Methyl Ester | 900.0 |
| 2. Hydroxylated/Acetylated Lecithin | 40.0 |
| 3. Surfactant | 60.0 |
| Total: | 1000.0 |

EXAMPLE 10

The procedure of Example 1 is followed with the following mixture:

| ITEM | POUNDS |
|---|---|
| 1. Fatty Ester | 500.0 |
| 2. Chemically Modified Lecithin | 500.0 |
| Total: | 1000.0 |

As seen in Example 10 above, an embodiment of the invention is shown where no surfactant is used at all. In this alternative embodiment, the lubricant additive mixture consists, in weight percent, approximately 20–80% emulsifier and 20–80% fatty ester. In particular, in embodiment, the emulsifier is preferably a chemically modified lecithin such a hydroxylated lecithin, acetylated lecithin, saponified hydroxylated lecithin and saponified acetylated lecithin. In addition, the fatty ester, as opposed to a fatty acid, is employed. Commonly, fatty ester are formed by reacting fatty acid with glycol, for example, to form the fatty ester. This invention preferably employs a glycol ester and can employ other esters such as methyl ester, butylene glycol ester, ethylene glycol ester, pentaerythritol ester, polyethylene glycol ester, polypropylene glycol ester, propylene glycol ester, sorbitol ester, and trimethylol ethane ester. It is preferred that this additive mixture contain approximately 50% chemically modified lecithin and 50% fatty ester. Depending on the chemically modified lecithin and ester employed, the mixture percentage will vary.

In the embodiment shown in Example 10, no surfactant is employed whatsoever. Chemically modified lecithins, which are much more soluble than crude lecithins, provide dispersibility and lubrication of the mixture to obviate the need for surfactants. As a result, the employment of a chemically modified lecithin, as the emulsifier in the additive mixture, aids in the dispersibility of the fatty ester. Since no surfactant is employed in Example 10, a better self-emulsifying product is provided which does not require a surfactant. This composition realizes a smoother additive mixture which is more dispersible, provides a smoother surface on the paper, has better runnability and can run faster on a paper coating machine.

As can be seen from the foregoing examples, the lubricant composition for coating moving webs of the present invention may be easily modified to accommodate different paper mill requirements and different levels of pigment solids to accommodate today's high speed printing processes and equipment. While the components of the present invention are described, other similar materials for the components may be employed without departing from the scope of the invention. In addition, the lubricant composition of the present invention may be used as an additive to other paper coatings to enhance their properties accordingly while maintaining the expected qualities of brightness, smoothness, gloss, optical density and flow characteristics.

It would be appreciated by those skilled in the art that various changes and modifications can be made to the illustrated embodiments without departing from the spirit of the present invention. All such modifications and changes are intended to be covered by the appended claims.

What is claimed is:

1. A lubricant additive mixture adapted for combination with an aqueous-based paper or paperboard coating mixture, said additive mixture consisting of in weight percent:

20–80% chemically modified lecithin selected from the group consisting of hydroxylated lecithin, acetylated lecithin, and saponified lecithin; and 20–80% fatty ester, said fatty ester being selected from the group consisting of methyl ester, butylene glycol ester, ethylene glycol ester, pentaerythritol ester, polyethylene glycol ester, polypropylene glycol ester, propylene glycol ester, sorbitol ester, and trimethylol ethane ester.

2. The lubricant additive mixture of claim 1, wherein said additive mixture consists of in weight percent:

approximately 50% chemically modified lecithin; and approximately 50% fatty ester.

* * * * *